US010316397B2

(12) United States Patent
Sato et al.

(10) Patent No.: US 10,316,397 B2
(45) Date of Patent: Jun. 11, 2019

(54) METHOD OF PREPARING CYLINDRICAL METAL MEMBER, METALLIC INGOT FOR IMPACT PRESSING, AND METHOD OF PREPARING ELECTROPHOTOGRAPHIC PHOTORECEPTOR

(71) Applicant: FUJI XEROX CO., LTD., Tokyo (JP)

(72) Inventors: Akira Sato, Kanagawa (JP); Daisuke Haruyama, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 297 days.

(21) Appl. No.: 15/230,608

(22) Filed: Aug. 8, 2016

(65) Prior Publication Data

US 2017/0259324 A1 Sep. 14, 2017

(30) Foreign Application Priority Data

Mar. 11, 2016 (JP) ..... 2016-048864

(51) Int. Cl.

| | |
|---|---|
| ***B21C 1/00*** | (2006.01) |
| ***B21C 1/26*** | (2006.01) |
| ***C22F 1/04*** | (2006.01) |
| ***G03G 5/05*** | (2006.01) |
| ***G03G 5/10*** | (2006.01) |
| ***B21C 23/18*** | (2006.01) |

(52) U.S. Cl.

CPC ..... *C22F 1/04* (2013.01); *B21C 1/003* (2013.01); *B21C 1/26* (2013.01); *B21C 23/186* (2013.01); *G03G 5/05* (2013.01); *G03G 5/102* (2013.01)

(58) Field of Classification Search

CPC ..... Y10T 29/4956; Y10T 29/49565; B21C 23/186; B21C 23/18; B21C 23/217; B21C 23/32; B21C 37/065; G03G 5/102; G03G 15/30; G03G 2215/1619

USPC ..... 72/41, 42

See application file for complete search history.

(56) References Cited

U.S. PATENT DOCUMENTS 2,136,725 A * 11/1938 Orozco ..... B21B 45/0242 72/236
2,329,731 A * 9/1943 Spring ..... C10M 173/02 72/362
2,748,464 A * 6/1956 Kaul ..... B21K 21/06 138/109
2,789,344 A * 4/1957 Kaul ..... B21C 23/03 220/581

(Continued)

FOREIGN PATENT DOCUMENTS

JP 2008-132503 A 6/2008

OTHER PUBLICATIONS

Rapoport et al., Friction and wear of MoS2 films on laser textured steel surfaces, 2008, Science Direct.*

*Primary Examiner* — Jason L Vaughan
(74) *Attorney, Agent, or Firm* — Sughrue Mion, PLLC

(57) ABSTRACT

A method of preparing a cylindrical metal member includes preparing a metallic ingot having at least one surface having a mean width with respect to roughness Sm in a range of from 100 μm to 220 μm; imparting a lubricant to the at least one surface of the metallic ingot; and subjecting the metallic ingot to impact pressing while the surface coated with the lubricant with respect to the metallic ingot is set as a bottom surface, to thereby mold a cylindrical metal member.

14 Claims, 4 Drawing Sheets

(56) References Cited

U.S. PATENT DOCUMENTS 2,810,478 A * 10/1957 Sejournet ..... B21C 23/32 72/358
2,898,331 A * 8/1959 Dorinson ..... 508/344
2,971,644 A * 2/1961 Sejournet ..... B21C 23/32 72/253.1
3,029,507 A * 4/1962 Gaggini ..... B21C 1/26 72/254
3,182,474 A * 5/1965 Buffet ..... B21C 23/32 72/253.1
3,242,075 A * 3/1966 Hunter ..... C10M 1/08 427/388.1
3,252,909 A * 5/1966 Jenks ..... C10M 3/00 508/189
3,269,943 A * 8/1966 Armstrong ..... B21C 37/28 428/68
3,335,589 A * 8/1967 Buffet ..... B21C 23/32 72/253.1
3,361,666 A * 1/1968 Webb ..... C10M 7/00 508/123
3,481,762 A * 12/1969 Streicher ..... B22F 3/20 428/469
3,840,461 A * 10/1974 Espunes ..... C10M 125/28 508/136
4,441,354 A * 4/1984 Bodega ..... B21D 22/28 72/342.1
4,803,000 A * 2/1989 Uematsu ..... C10M 105/00 508/431
4,885,042 A * 12/1989 Kenmochi ..... B21B 3/02 72/365.2
5,964,117 A * 10/1999 Holroyd ..... B21C 23/20 72/258
6,034,041 A * 3/2000 Nittel ..... C10M 173/02 508/469
6,376,433 B1 * 4/2002 Connor ..... C10M 111/00 508/163
8,915,108 B2 * 12/2014 Rau ..... C10M 111/04 508/136
2002/0019321 A1 * 2/2002 Balliett ..... B21B 45/0242 508/246
2005/0005665 A1 * 1/2005 Ogura ..... B21C 23/186 72/358
2005/0279152 A1 * 12/2005 Fueller ..... B21K 5/20 72/462
2010/0011826 A1 * 1/2010 Buehler ..... C21D 7/06 72/42
2011/0189439 A1 * 8/2011 Sato ..... B32B 3/30 428/156
2014/0162917 A1 * 6/2014 Komiyama ..... C10M 103/06 508/175
2014/0295206 A1 * 10/2014 Aoya ..... B21C 23/217 428/600
2015/0175814 A1 * 6/2015 Aizenberg ..... B08B 17/06 428/312.8

* cited by examiner

METHOD OF PREPARING CYLINDRICAL METAL MEMBER, METALLIC INGOT FOR IMPACT PRESSING, AND METHOD OF PREPARING ELECTROPHOTOGRAPHIC PHOTORECEPTOR

CROSS-REFERENCE TO RELATED APPLICATIONS

This application is based on and claims priority under 35 USC 119 from Japanese Patent Application No. 2016-048864 filed Mar. 11, 2016.

BACKGROUND

1. Technical Field

The present invention relates to a method of preparing a cylindrical metal member, a metallic ingot for impact pressing, and a method of preparing an electrophotographic photoreceptor.

2. Related Art

In the related art, as an electrophotographic image forming apparatus, an apparatus sequentially performing steps of charging, exposing, developing, transferring, cleaning, and the like by using an electrophotographic photoreceptor (hereinafter, referred to as a "photoreceptor" in some case) has been widely known.

Examples of the electrophotographic photoreceptor include a function-separated type photoreceptor which is obtained by stacking a charge generation layer for generating charges by exposure and a charge transport layer for transporting the charges on a support such as aluminum having conductivity, and a single-layer type photoreceptor that has functions of generating and transporting the charges in the same layer.

As a method of preparing a cylindrical material which corresponds to the conductive support of the electrophotographic photoreceptor, a method of adjusting a thickness, surface roughness, and the like by cutting an outer circumferential surface of a tube material of aluminum or the like has been known.

Meanwhile, as a method of mass-producing a thin metal container or the like with low cost, an impact pressing method of molding a cylindrical metal member by imparting a shock (impact) to a metallic ingot (slug) which is disposed in a die (female die) by using a punch has been known.

SUMMARY

According to an aspect of the invention, there is provided a method of preparing a cylindrical metal member, the method including:

preparing a metallic ingot having at least one surface having a mean width with respect to roughness Sm in a range of 100 μm to 220 μm;

imparting a lubricant to the at least one surface of the metallic ingot; and subjecting the metallic ingot to impact pressing while the surface coated with the lubricant with respect to the metallic ingot is set as a bottom surface, to thereby mold a cylindrical metal member.

BRIEF DESCRIPTION OF THE DRAWINGS

Exemplary embodiments of the present invention will be described in detail based on the following figures, wherein.

DETAILED DESCRIPTION

Figure 1A:
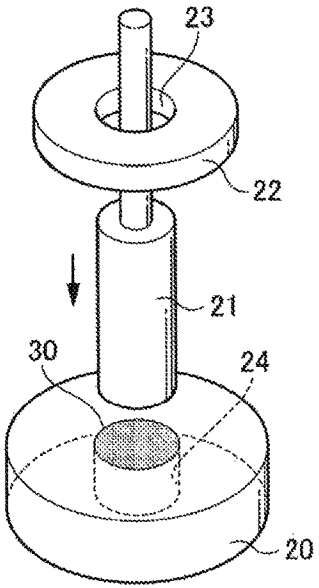
FIG. 1A to FIG. 1C are schematic diagrams respectively illustrating an example of impact pressing in a method of preparing a cylindrical metal member according to the exemplary embodiment.

Hereinafter, embodiments of the invention will be described with reference to the drawings. In the drawings, the same or equivalent components are denoted by the same reference numerals and the description thereof will not be repeated.

Method of Preparing Cylindrical Metal Member

The method of preparing a cylindrical metal member according to the exemplary embodiment includes a preparing step of preparing a metallic ingot having at least one surface having a mean width with respect to roughness Sm in a range of from 100 μm to 220 μm, a lubricant imparting step of imparting a lubricant to the at least one surface of the metallic ingot, and an impact pressing step of subjecting the metallic ingot to impact pressing while the surface coated with the lubricant with respect to the metallic ingot is set as a bottom surface, to thereby mold a cylindrical metal member.

In the typical impact pressing, for example, a metallic ingot (hereinafter, referred to as a "slug" in some cases) is disposed in a circular female die, and is hammered by a columnar male punch at a high pressure such that a cylindrical member is molded along the die.

For example, in a case where a cylindrical substrate for an electrophotographic photoreceptor is prepared by the impact pressing, after a cylindrical aluminum tube is molded by the impact pressing, inner and outer diameters, cylindricity, and circularity thereof are adjusted by an ironing, and then a photosensitive layer or the like is formed on an outer circumferential surface of the cylindrical member so as to prepare an electrophotographic photoreceptor.

However, when forming the cylindrical member by the impact pressing, a small cavity is formed in a specific area on the surface of the cylindrical member, and the number of the cavities becomes different depending on individual cylindrical members. If a toner image is formed by installing the electrophotographic photoreceptor, which is prepared by forming a photosensitive layer or the like on the outer circumferential surface of the cylindrical member having plural cavities described above, in an image forming apparatus, a printed image may be affected by the size of the cavities existing on the outer circumferential surface of the cylindrical member, and thereby a point defect may be caused.

As a factor of the cavities caused in the case of preparing the cylindrical member by the impact pressing, the following reason may be considered: when a lubricant is applied to the surface of the slug before being subjected to the impact pressing, in a case where the impact pressing is performed in a state of low uniformity of the applied lubricant, cracks having a diameter of approximately 15 μm exist on the surface of the slug, and in this case, the cracks expands to be cavities having a diameter of approximately 200 μm.

In contrast, according to the method of preparing a cylindrical metal member of the exemplary embodiment, the cylindrical metal member in which the concavities are prevented from being formed on the outer circumferential surface may be prepared. The reason for this is considered as follows.

In the method of preparing a cylindrical metal member according to the exemplary embodiment, a slug having at least one surface on which a mean width with respect to roughness Sm is from 100 μm to 220 μm is used. When the lubricant is imparted to the surface of the slug, the lubricant easily enters concave portions existing on the surface to which the lubricant is imparted, and adhesive properties of the lubricant are improved, thereby imparting the lubricant with high uniformity.

In addition, the surface of the slug to which the lubricant is applied is set as a bottom surface, and is subjected to the impact pressing such that a portion of the bottom surface of the slug before being subjected to the impact pressing is extended as the outer circumferential surface of the cylindrical metal member. In this case, the lubricant is imparted to the bottom surface of the slug with high uniformity, and thus it is considered that the bottom surface portion of the slug is extended with high uniformity by the impact pressing, and the generation of the cavities and the expansion of the concave portions on the outer circumferential surface of the cylindrical metal member are prevented.

Hereinafter, as an example of the method of preparing a cylindrical metal member according to the exemplary embodiment, a case of preparing a cylindrical substrate for an electrophotographic photoreceptor will be described in detail.

In the case of preparing the cylindrical substrate for an electrophotographic photoreceptor by using, for example, the method of preparing the cylindrical metal member according to the exemplary embodiment, it is preferable to perform a preparing step of preparing a slug having at least one surface on which a mean width with respect to roughness Sm is from 100 μm to 220 μm, a lubricant imparting step of imparting a lubricant to the surface of the slug, an impact pressing step of molding a cylindrical metal member in such a manner that the surface to which the lubricant is imparted is set as a bottom surface with respect to the slug, and an ironing step of performing ironing on the outer circumferential surface of the cylindrical metal member. Hereinafter, the respective steps will be specifically described.

Preparing Step

In the preparing step, a slug having at least one surface on which a mean width with respect to roughness Sm is from 100 μm to 220 μm is prepared.

A material, a shape, a size, and the like of the slug may be selected in accordance with the application of the cylindrical metal member to be prepared.

In a case of preparing a cylindrical substrate for forming an electrophotographic photoreceptor, a disk-shaped slug or a columnar slug formed of aluminum or an aluminum alloy is preferably used.

Note that, depending on the application of the cylindrical metal member to be prepared, slugs such as an elliptic columnar slug and a prismatic slug may be used.

Examples of the aluminum alloy contained in the slug include an aluminum alloy containing Si, Fe, Cu, Mn, Mg, Cr, Zn, and Ti in addition to aluminum.

The aluminum alloy contained in the slug which is used to preparing the cylindrical substrate of the electrophotographic photoreceptor is preferably a so-called 1000-series alloy.

The aluminum content of (aluminum purity: weight ratio) of the slug is preferably 90.0% or more, further preferably 93.0% or more, and still further preferably 95.0% or more, from the point of view of processability.

Namely, the metallic ingot prepared by the slug also contain aluminum in an amount of preferably 90.0% by weight or more, further preferably 93.0% by weight or more, and still further preferably 95.0% by weight or more.

A method of preparing the slug is not limited, and in a case where the columnar or disk-shaped slug is used, a method of cutting a rod-shaped metal material having a circular cross section which intersects with the longitudinal direction to the length corresponding to the height (thickness) of the slug, and a method of punching a metal substrate having the thickness corresponding to the height (thickness) of the slug into a circular shape are used, for example.

The slug is formed into a cylindrical or disk shape, and one surface (end surface) thereof corresponds to a bottom at the time of performing the impact pressing (a surface opposite to the surface hammered by a mail die, and hereinafter, referred to as a "slug bottom surface"). In the exemplary embodiment, a slug in which a mean width with respect to roughness Sm of the surface corresponding to the bottom surface in the impact pressing is in a range of from 100 μm to 220 μm may be prepared. The mean width with respect to roughness Sm is obtained in such a manner that a reference length is extracted in the direction of an average line from a roughness curve, the total length of average lines corresponding to one summit and one valley adjacent to the summit is calculated, and then an average value of the total length is indicated by millimeter (mm). The measurement of the mean width with respect to roughness Sm on the surface of the slug which is used in the exemplary embodiment is performed based on JISB 0601 (issued in 1994).

In addition, the maximum height Ry of the surface (the surface on which the mean width with respect to roughness Sm is from 100 μm to 220 μm) of the slug which corresponds to the bottom surface in the impact pressing is preferably in a range of from 10 μm to 30 μm. The maximum height Ry is obtained in such a manner that a reference length is extracted in the direction of an average line from a roughness curve, an interval between a summit line and a valley line in the extracted portion is measured in the direction of longitudinal magnification of the roughness curve, and then the obtained value is indicated by micrometer (μm). The measurement of the maximum height Ry in the surface of the slug used in the exemplary embodiment is performed based on JISB 0601 (issued in 1994).

When the maximum height Ry of the slug bottom surface is in the above-described range, the lubricant is easily attached to the slug bottom surface, and the coating uniformity of the lubricant may be improved. In addition, the maximum diameter of the concave portion on the outer circumferential surface of the cylindrical member obtained by the impact pressing may be made to be small.

From the above aspect, the maximum height Ry of the slug bottom surface is preferably from 10 μm to 30 μm, and is particularly preferably from 10 μm to 20 μm.

A method of allowing the mean width with respect to roughness Sm of the slug bottom surface to be in a range of from 100 μm to 220 μm is not particularly limited, and it is preferable that the slug bottom surface obtained by punching the above-described metal substrate is subjected to shot peening and thus the mean width with respect to roughness Sm of the slug bottom surface is made to be in the above-described range. The shot peening is a processing method of work performing hardening through plastic deformation or imparting a compressive residual stress by projecting steel particles or non-ferrous metal particles with respect to a surface to be treated to cause the particles to collide with the surface to be treated.

In a case where the slug bottom surface is subjected to the shot peening, the mean width with respect to roughness Sm in the slug bottom surface is from 100 μm to 220 μm, and conditions may be set in accordance with the material or the like of the slug such that the maximum height Ry is further preferably from 10 μm to 30 μm.

The surface roughness such as Sm and Ry on the slug bottom surface by the shot peening may be controlled by a material, a particle size, and a shape of a projection material, a projection pressure, a projection time, and a projection distance (a distance from a projection port of a shot-peening apparatus to the plan surface (surface to be treated) of the slug).

Examples of the projection materials used in the shot peening in the exemplary embodiment include zircon, glass, and stainless.

The projection material is preferably formed into a spherical shape or a shape similar to a spherical shape, and the particle size is preferably from 10 μm to 100 μm, and further preferably from 10 μm to 50 μm from the view point that the mean width with respect to roughness Sm on the slug bottom surface is from 100 μm to 220 μm.

In addition, as the projection pressure is higher, the projection time is longer, and the projection distance is closer, the surface roughness of Sm and Ry are likely to be larger, and the conditions may be selected in accordance with the material of the slug, a target surface roughness, and the like.

An apparatus for performing the shot peening is not limited, and for example, an apparatus which is provided with a mechanism for rotating a member to be treated which is subjected to the shot peening is used to project a projection material to the slug bottom surface while rotating the slug, and thereby improving the uniformity of the surface roughness (Sm, Ry, and the like).

Lubricant Imparting Step

In the lubricant imparting step, a lubricant is imparted to the surface of the slug.

A lubricant used in the exemplary embodiment may be selected in accordance with the material of the slug or a cylindrical metal member to be prepared, and is preferably a solid lubricant, and is further preferably in a powder state from the view point of handling properties, holding properties on the surface to be coated, and the coating uniformity. The solid lubricant used in the exemplary embodiment is preferably in a solid shape at normal temperature (20° C.), and examples thereof include fatty acid metal salt such as lead oleate, zinc oleate, copper oleate, zinc stearate, iron stearate, magnesium stearate, copper stearate, iron palmitate, copper palmitate, and zinc myristate, and a fluorine resin such as polyvinylidene fluoride, polytrifluoroethylene, and tetrafluoroethylene. Particularly, the zinc stearate is preferably used from the viewpoint of excellent lubricity and coating properties.

A method of imparting the lubricant to the slug bottom surface is not limited, and an imparting method may be selected in accordance with properties of the lubricant to be used, the size of the slug bottom surface to which the lubricant is imparted, and the like. For example, in a case where the solid lubricant is used, the solid lubricant is applied to the slug bottom surface by using a brush, and thus the high uniformity may be realized.

The amount of imparting the lubricant to the slug bottom surface depends on the types of the lubricants, but, when the amount of the lubricant to be imparted to the slug bottom surface is excessively small, it is likely that the number and the sizes of the concave portions existing on the outer circumferential surface of the cylindrical metal member after being subjected to the impact pressing are increased, and when the amount of the lubricant imparted to the slug bottom surface is excessively large, it is likely that the reduction of workability and the increase in preparing cost are caused at time of the impact pressing. From the above aspect, the amount of the lubricant to be imparted to the slug bottom surface is preferably from 0.5 $mg/cm^2$ to 1.5 $mg/cm^2$, is further preferably from 0.5 $mg/cm^2$ to 1.0 $mg/cm^2$, and is particularly preferably from 0.6 $mg/cm^2$ to 0.9 $mg/cm^2$.

Impact Pressing Step

In the impact pressing step, the surface to which the lubricant is imparted is set as the bottom surface with respect to the slug, and the bottom surface is subjected to the impact pressing so as to mold a cylindrical metal member.

FIG. 1 illustrates an example of a step of molding a cylindrical member by performing the impact pressing on a slug.

The lubricant is applied to an end surface (a slug bottom surface) of a columnar slug 30, and as illustrated in FIG. 1A, the columnar slug 30 is disposed into a circular hole 24 which is provided in a die (a female die) 20. Here, the mean width with respect to roughness Sm is from 100 μm to 220 μm, and the end surface to which the solid lubricant is applied is set as the bottom surface and the slug 30 is disposed in the die 20.

Figure 1B:
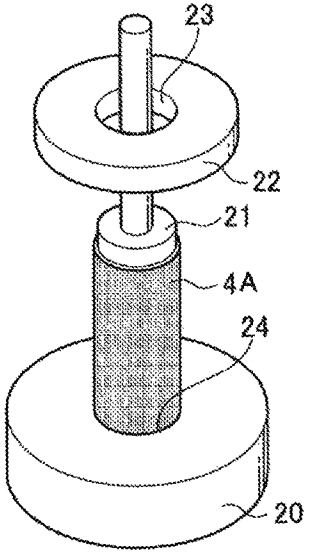

Next, as illustrated in FIG. 1B, the slug 30 disposed in the die 20 is pressed by using a columnar punch (male die) 21. With this, the slug 30 is molded by being cylindrically extended from the circular hole of the die 20 so as to surround the punch 21. At this time, a portion of the bottom surface of the slug 30 before being subjected to the impact pressing is extended as an outer circumferential surface of a cylindrical member 4A, and the surface roughness on the outer circumferential surface of the cylindrical member 4A is reflected by the surface roughness on the bottom surface of the slug 30.

Figure 1C:
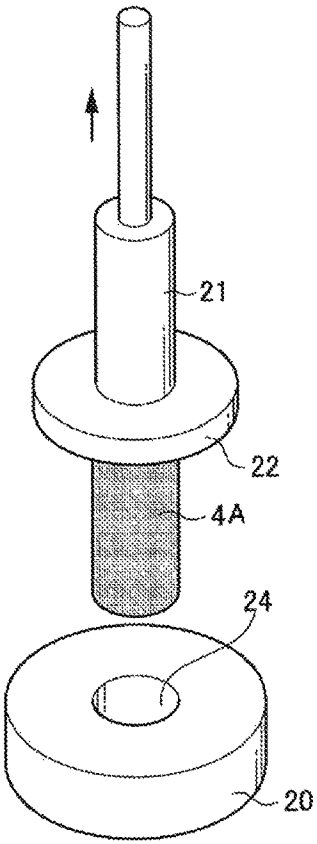

After molding, as illustrated in FIG. 1C, the punch 21 is pulled up and passes through a center hole 23 of a stripper 22 such that the punch 21 is extracted, and thereby the cylindrical molded article (cylindrical member) 4A is obtained.

As described above, the concave portions may be prevented from being formed on the outer circumferential surface by performing the impact pressing, and thus the hardness is enhanced due to the work hardening, thereby preparing the thin cylindrical molded article (cylindrical member) 4A with high hardness.

Meanwhile, the thickness of the cylindrical member 4A is not particularly limited, but in a case where the cylindrical member 4A is prepared as the cylindrical substrate for an electrophotographic photoreceptor, the thickness of the cylindrical member 4A molded by the impact pressing is preferably from 0.4 mm to 0.8 mm, and is further preferably from 0.4 mm to 0.6 mm, from the viewpoint that the processing is performed such that the thickness is from 0.2 mm to 0.9 mm by the subsequent ironing while maintaining the hardness.

Ironing Step

In the ironing step, the cylindrical member molded by the impact pressing step is subjected to the ironing so as to adjust inner and outer diameters, cylindricity, circularity, and the like.

Note that, in a case where the method of preparing a cylindrical metal member according to the exemplary embodiment is applied to prepare the cylindrical substrate of the electrophotographic photoreceptor, the ironing step is performed, however, the ironing step may be performed if necessary in consideration of the purposed of a cylindrical metal member to be prepared.

Figure 2B:
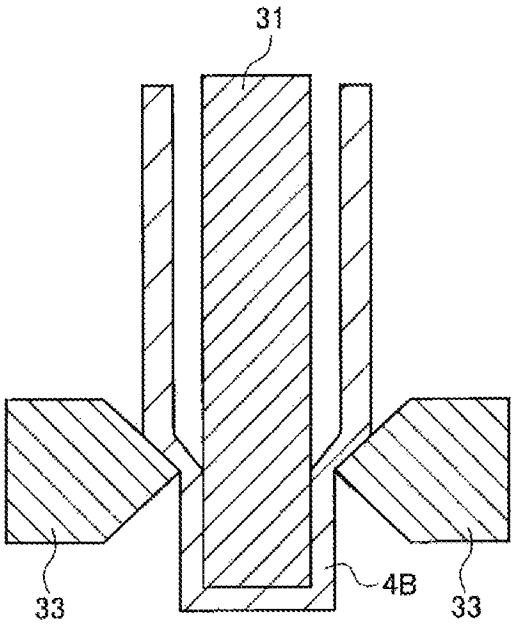
FIG. 2A and FIG. 2B are schematic diagrams respectively illustrating an example of a drawing and ironing in the method of preparing the cylindrical metal member according to the exemplary embodiment.
Figure 2A:
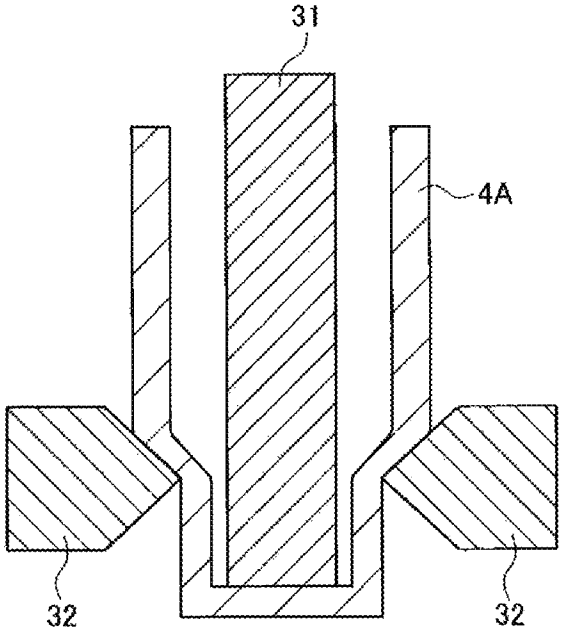

Specifically, the cylindrical member 4A which is molded by the impact pressing is pushed into a die 32 by using the columnar punch 31 inside the cylindrical member 4A and then subjected to a drawing if necessary so as to make the diameter thereof small as illustrated in FIG. 2A, and then the cylindrical member 4A is pushed into between dies 33 and is subjected to the ironing so as to make the diameter thereof smaller as illustrated in FIG. 2B. Note that, the ironing may be performed without performing the drawing, or the ironing may be performed in plural steps. With the number of times of the ironing, a thickness of the cylindrical member 4B is adjusted.

In addition, before performing the ironing, an annealing may be performed so as to release a stress.

The thickness of the cylindrical member 4B after being subjected to the ironing is preferably from 0.2 mm to 0.9 mm, and is further preferably from 0.4 mm to 0.6 mm from the viewpoint that the hardness of a substrate for an electrophotographic photoreceptor is maintained.

In this way, when the cylindrical member 4A is molded by the impact pressing in the exemplary embodiment, and then is subjected to the ironing, a thin and light cylindrical substrate in which the concave portions are less likely to be formed on the outer circumferential surface is obtained with high hardness.

According to the method of preparing a cylindrical metal member of the exemplary embodiment, the concave portions are prevented from being formed on the outer circumferential surface, and thus it is possible to prepare a cylindrical substrate having the same quality of the substrate which is prepared by cutting method, and in a case where the cylindrical metal member is mass-produced, an automatic surface inspection may be omitted.

Meanwhile, in a case where the photoreceptor is used for a laser printer, an oscillation wavelength of the laser is preferably from 350 nm to 850 nm, and as the wavelength is shorter, a resolution becomes excellent. In order to prevent interference fringes from being formed when the surface is irradiated with a laser beam, the surface of the cylindrical substrate is preferably roughened such that the surface roughness Ra is from 0.04 μm to 0.5 μm. When the surface roughness Ra is equal to or greater than 0.04 μm, the interference fringes may be prevented, whereas when the surface roughness Ra is equal to or less than 0.5 μm, the image quality may be efficiently prevented from being roughened.

Note that, in a case where the non-interference light is used as a light source, the roughening is not necessarily performed to prevent the interference fringes, defects caused by the roughness on the surface of the cylindrical substrate are prevented, and thereby the non-interference light is further suitable for long lifetime.

Examples of the roughening method include a wet honing process performed in such a manner that an abrasive agent is suspended in water and the suspension is sprayed to the cylindrical substrate, a centerless grinding process performed by continuously grinding by pressing a rotating grinding wheel with the cylindrical substrate, an anodic oxidation treatment, and a method of forming a layer containing organic or inorganic conductive particles.

The anodic oxidation treatment is performed in such a manner than aluminum is set as an anode, and then is subjected to anodic oxidation in an electrolyte solution, thereby forming an oxide film on the aluminum surface. Examples of the electrolyte solution include a sulfuric acid solution, an oxalic acid solution, and the like. However, a porous anodic oxide film, which is as it is after treatment, is in a chemically active state, and thus is likely to be contaminated, and resistance variation is large due to environment. In this regard, it is preferable that the anodic oxide film is treated by pressurized steam or boiling water (metal salts such as nickel may be added), and then is subjected to a sealing treatment in which volume expansion due to a hydration reaction of fine holes is performed and thus further stable hydrated oxide is obtained.

The thickness of the anodic oxide film is, for example, preferably from 0.3 μm to 15 μm. When this film thickness is in the above-described range, it is likely that barrier properties are exhibited with respect to injection, and an increase in residual potentials due to the repeated used is prevented.

The outer circumferential surface of the cylindrical substrate may be subjected to a treatment with an acidic treatment solution, or a boehmite treatment.

The treatment with the acidic treatment solution is performed as follows by using the acidic treatment solution formed of phosphoric acid, chromic acid, and hydrofluoric acid. As for the mixing ratio of the phosphoric acid, the chromic acid, and the hydrofluoric acid in the acidic treatment solution, the phosphoric acid is from 10% by weight to 11% by weight, the chromic acid is from 3% by weight to 5% by weight, and the hydrofluoric acid is from 0.5% by weight to 2% by weight, and a density of the entire acids is preferably from 13.5% by weight to 18% by weight. The treatment temperature is, for example, from 42° C. to 48° C., and when the high treatment temperature is maintained, a thick coating film is further rapidly formed. The thickness of the coating film is preferably from 0.3 μm to 15 μm.

The boehmite treatment is performed by impregnating the cylindrical substrate in pure water at 90° C. to 100° C. for 5 minutes to 60 minutes, or by keeping the cylindrical substrate in heated steam at 90° C. to 120° C. for 5 minutes to 60 minutes. The thickness of the coating film is preferably from 0.1 μm to 5 μm. The treated cylindrical substrate may be further subjected to the anodic oxidation treatment by using an electrolyte solution having a low coating solubility such as adipic acid, boric acid, borate, phosphate, phthalate, maleate, benzoate, tartrate, and citrate.

Method of Preparing Electrophotographic Photoreceptor

The method of preparing an electrophotographic photoreceptor according to the exemplary embodiment includes a step of preparing a cylindrical metal member which is prepared as an electrophotographic photoreceptor substrate by using the method of preparing a cylindrical metal member of the exemplary embodiment, and a step of forming a photosensitive layer on the outer circumferential surface of the cylindrical metal member.

Figure 3:
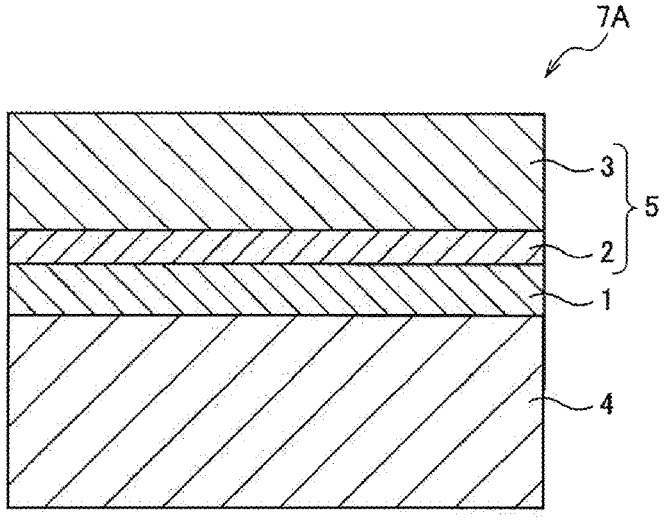
FIG. 3 is a schematic partial sectional view illustrating an example of a configuration of an electrophotographic photoreceptor which is prepared by using a method of preparing an electrophotographic photoreceptor according to the exemplary embodiment.

FIG. 3 is a schematic partial sectional view illustrating an example of a layer configuration of the electrophotographic photoreceptor which is prepared by using the method of preparing an electrophotographic photoreceptor according to the exemplary embodiment. An electrophotographic photoreceptor 7A as illustrated in FIG. 3 has a structure in which an undercoat layer 1, a charge generation layer 2, and a charge transport layer 3 are sequentially stacked on a cylindrical substrate 4, and the charge generation layer 2 and the charge transport layer 3 form a photosensitive layer 5.

Meanwhile, the electrophotographic photoreceptor is not limited to the layer configuration illustrated in FIG. 3, and a protective layer is further formed on the photosensitive layer as an outermost layer. In addition, the undercoat layer 1 may not be necessarily provided, and a single-layer type photosensitive layer in which functions of the charge generation layer 2 and the charge transport layer 3 are integrated may be employed.

Image Forming Apparatus (and Process Cartridge)

The image forming apparatus according to the exemplary embodiment is provided with an electrophotographic photoreceptor, a charging unit that charges the surface of the electrophotographic photoreceptor, an electrostatic latent image forming unit that forms an electrostatic latent image on the charged surface of the electrophotographic photoreceptor, a developing unit that develops the electrostatic latent image formed on the surface of the electrophotographic photoreceptor by using a developer containing a toner, a transfer unit that transfers the toner image to a surface of a recording medium. In addition, as the electrophotographic photoreceptor, an electrophotographic photoreceptor which is prepared by using the method of preparing an electrophotographic photoreceptor according to the exemplary embodiment is employed.

As the image forming apparatus according to the exemplary embodiment, well-known image forming apparatuses such as an apparatus including a fixing unit that fixes a toner image transferred on a surface of a recording medium; a direct-transfer type apparatus that directly transfers the toner image formed on the surface of the electrophotographic photoreceptor to the recording medium; an intermediate transfer type apparatus that primarily transfers the toner image formed on the surface of the electrophotographic photoreceptor to a surface of an intermediate transfer member, and secondarily transfers the toner image transferred to the intermediate transfer member to the surface of the recording medium; an apparatus including a cleaning unit that cleans the surface of the electrophotographic photoreceptor before being charged and after transferring the toner image; an apparatus includes an erasing unit that erases charges by irradiating the electrophotographic photoreceptor with erasing light before being charged and after transferring the toner image; and an apparatus including an electrophotographic photoreceptor heating member that increase the temperature of the electrophotographic photoreceptor so as to decrease a relative temperature are employed.

In a case where the intermediate transfer type apparatus is used, the transfer unit is configured to include an intermediate transfer member that transfers the toner image to the surface, a primary transfer unit that primarily transfers the toner image formed on the surface of the electrophotographic photoreceptor to the surface of the intermediate transfer member, and a secondary transfer unit that secondarily transfers the toner image formed on the surface of the intermediate transfer member to the surface of the recording medium.

Note that, in the image forming apparatus according to the exemplary embodiment, for example, a unit including the electrophotographic photoreceptor may be a cartridge structure (process cartridge) detachable from the image forming apparatus. As a process cartridge, for example, a process cartridge including the electrophotographic photoreceptor according to the exemplary embodiment is preferably used. In addition, in addition to the electrophotographic photoreceptor, at least one selected from the group consisting of a charging unit, an electrostatic charge image forming unit, a developing unit, and a transfer unit may be included in the process cartridge.

Hereinafter, an example of the image forming apparatus of the exemplary embodiment will be described; however, the invention is not limited thereto. Note that, in the drawing, major portions will be described, and others will not be described.

Figure 4:
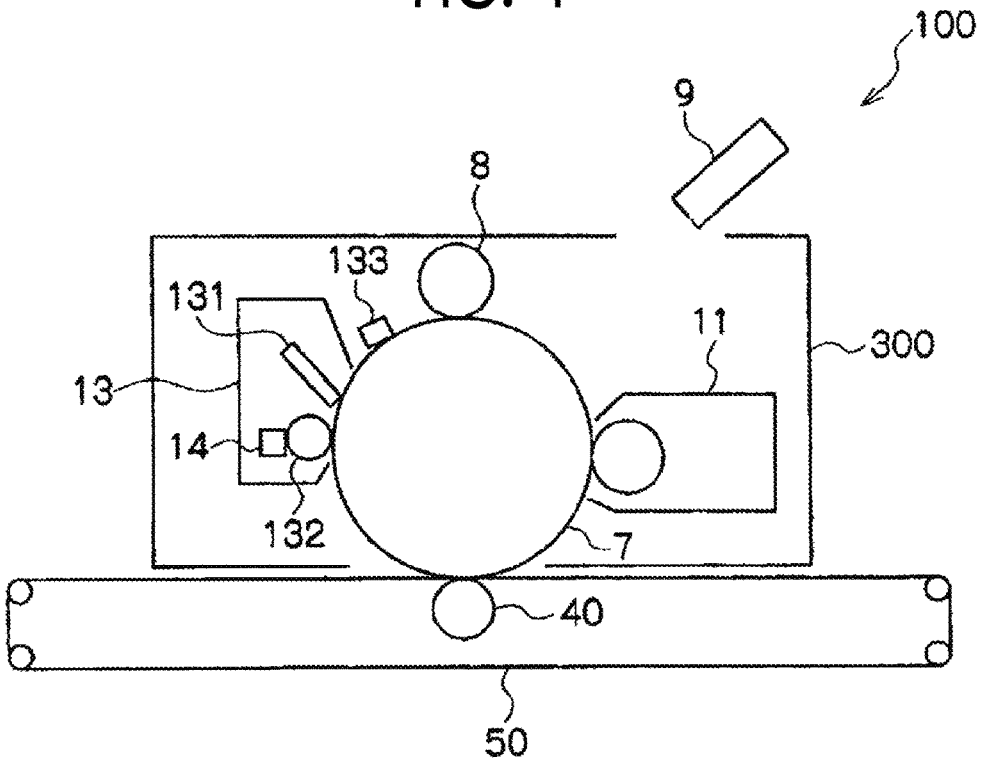
FIG. 4 is a schematic configuration diagram illustrating an example of an image forming apparatus.

FIG. 4 is a schematic configuration illustrating an example of the image forming apparatus according to the exemplary embodiment.

As illustrated in FIG. 4, an image forming apparatus 100 according to the exemplary embodiment includes a process cartridge 300 which is provided with an electrophotographic photoreceptor 7, an exposure device 9 (an example of the electrostatic latent image forming unit), a transfer device 40 (the primary transfer device), and an intermediate transfer member 50. In addition, in the image forming apparatus 100, the exposure device 9 is disposed at a position so as to expose the electrophotographic photoreceptor 7 from an opening of the process cartridge 300, the transfer device 40 is disposed at a position facing the electrophotographic photoreceptor 7 via the intermediate transfer member 50, and the intermediate transfer member 50 is disposed such that a portion thereof contacts the electrophotographic photoreceptor 7. Although not shown, the image forming apparatus 100 also includes a secondary transfer device that transfers the toner image which is transferred to the intermediate transfer member 50 to a recording medium (for example, recording sheet). Note that, the intermediate transfer member 50, the transfer device 40 (the primary transfer device), and the secondary transfer device (not shown) correspond to examples of the transfer unit.

The process cartridge 300 in FIG. 4 integrally supports the electrophotographic photoreceptor 7, a charging device 8 (an example of the charging unit), a developing device 11 (an example of the developing unit), and a cleaning device 13 (an example of the cleaning unit) in a housing. The cleaning device 13 includes a cleaning blade (an example of the cleaning member) 131, the cleaning blade 131 is disposed so as to contact the surface of the electrophotographic photoreceptor 7. Note that, the cleaning member is not limited to the cleaning blade 131, and may be a conductive or an insulating fibrous member, which may be used alone or used in combination with the cleaning blade 131.

Meanwhile, FIG. 4 illustrates an example of the image forming apparatus including a fibrous member 132 (roller shape) for supplying a lubricant 14 to the surface of the electrophotographic photoreceptor 7, and a fibrous member 133 (flat brush shape) for assisting the cleaning step, and the above members are disposed in accordance with the use.

Figure 5:
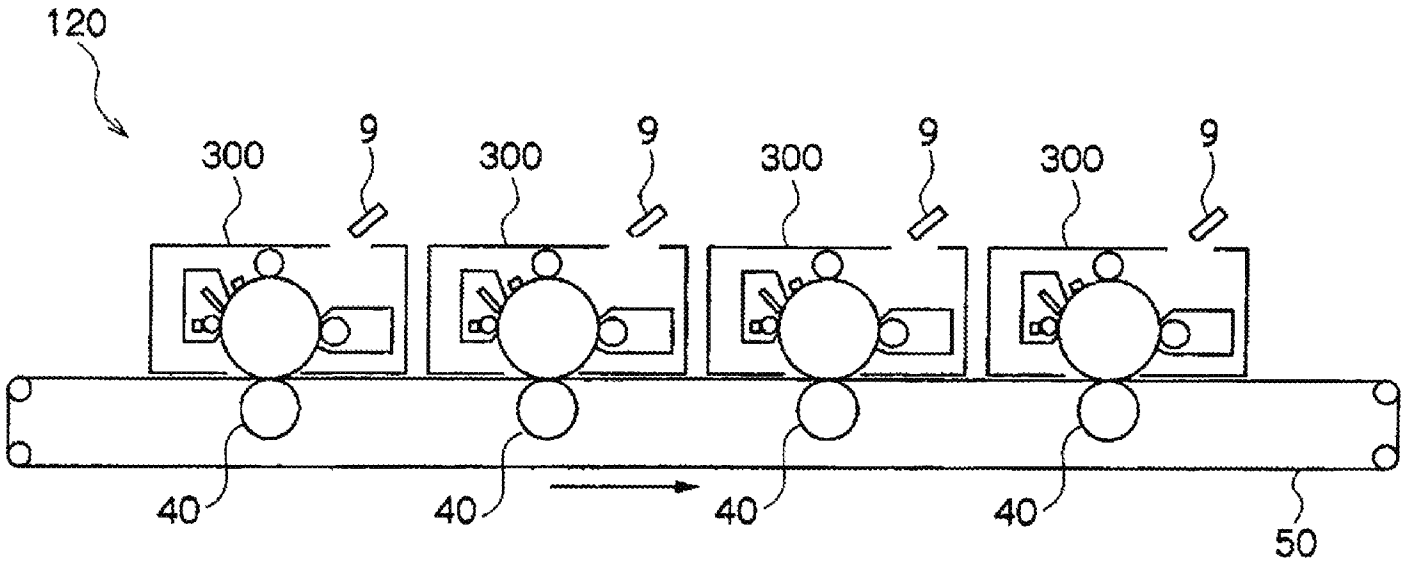
FIG. 5 is a schematic configuration diagram illustrating another example of an image forming apparatus.

FIG. 5 is a schematic configuration diagram illustrating another example of an image forming apparatus according to the exemplary embodiment.

An image forming apparatus 120 illustrated in FIG. 5 is a tandem type multi-color image forming apparatus including four process cartridges 300. In the image forming apparatus 120, the four process cartridges 300 are arranged in parallel on the intermediate transfer member 50, and one electrophotographic photoreceptor is used for one color. Note that, the image forming apparatus 120 has a configuration which is the same as that of the image forming apparatus 100 except that it is a tandem type image forming apparatus.

Note that, in the description according to the above exemplary embodiment, a case of preparing the cylindrical substrate for an electrophotographic photoreceptor by using the method of preparing a cylindrical metal member according to the exemplary embodiment is mainly described; however, the method of preparing a cylindrical metal member according to the exemplary embodiment is not limited to the preparing of the cylindrical substrate for an electrophotographic photoreceptor. The method of preparing a cylindrical metal member according to the exemplary embodiment may be used to prepare a cylindrical substrate such as a charging roller and a transfer roller in the image forming apparatus, and may be used to prepare a cylindrical member such as a capacitor case, a battery case, and a magic pen in addition to the image forming apparatus.

EXAMPLES

Hereinafter, Examples of the present invention will be described; however, the invention is not limited to the following Examples.

Preparing Cylindrical Tube

Comparative Example 1

An aluminum columnar slug having a diameter of 34 mm, and a thickness of 15 mm is prepared by punching an aluminum plate having a thickness of 15 mm. When the surface roughness of an end surface of the slug is measured by using a surface roughness measuring machine (SURFCOM, manufactured by Tokyo Seimitsu Co., Ltd.), the mean width with respect to roughness Sm is 50 μm, and the maximum height Ry is 18 μm.

The end surface of the slug is coated with powder lubricant zinc stearate by using a brush. The coating amount of the solid lubricant is 0.3 mg/cm$^2$. The end surface of the slug with which the solid lubricant is coated is set as a bottom surface and is subjected to the impact pressing so as to mold a cylindrical tube having a diameter of 34 mm and a length of 150 mm.

A distribution of the concave portions on the outer circumferential surface of the obtained cylindrical tube is created by using an automatic surface inspecting machine, and when the number of the concave portion and the size thereof are measured based on the distribution of the concave portions by using a laser microscope, 10 or more concave portions having the maximum diameter of equal to or greater than 200 μm are confirmed.

Example 1

An aluminum columnar slug having a diameter of 34 mm, and a thickness of 15 mm is prepared by punching an aluminum plate having a thickness of 15 mm, and the end surface of the slug is subjected to a shot peening by using a shot-peening apparatus (manufactured by Fuji Seisakusho Co., Ltd.) under the following conditions.

Projection material: ZIRCON 400 manufactured by Fuji Seisakusho Co., Ltd. (center particle size of 60 μm)

Projection pressure: 0.3 MPa

Projection time: 10 seconds

Shot distance: 150 mm

Slug rotational speed: 40 rpm

When the surface roughness on the end surface of the slug which is subjected to the shot peening is measured by using a surface roughness measuring machine (SURFCOM, manufactured by Tokyo Seimitsu Co., Ltd.), the mean width with respect to roughness Sm is 140 μm, and the maximum height Ry is 23 μm.

When powder lubricant zinc stearate is imparted to the end surface of the slug which is subjected to the shot peening by using a brush, the coating amount is 0.8 mg/cm$^2$, and high uniformity is obtained in the coating. The end surface of the slug with which the solid lubricant is coated is set as a bottom surface and is subjected to the impact pressing so as to mold a cylindrical tube having a diameter of 34 mm and a length of 150 mm.

A distribution of the concave portions on the outer circumferential surface of the obtained cylindrical tube E1 is created by using an automatic surface inspecting machine, and when the number of the concave portion and the size thereof are measured based on the distribution of the concave portions by using a laser microscope, the number of the concave portions is decreased approximately 90% as compared with the cylindrical tube prepared in Comparative example 1, and the size of the maximum concave portion is approximately 100 μm.

Example 2

An aluminum columnar slug having a diameter of 34 mm, and a thickness of 15 mm is prepared by punching an aluminum plate having a thickness of 15 mm, and the end surface of the slug is subjected to a shot peening by using a shot-peening apparatus (manufactured by Fuji Seisakusho Co., Ltd.) under the following conditions (projection pressure is changed to 0.5 MPa under the condition of Example 1).

Projection material: ZIRCON 400 manufactured by Fuji Seisakusho Co., Ltd. (center particle size 60 μm)

Projection pressure: 0.5 MPa

Projection time: 10 seconds

Shot distance: 150 mm

Slug rotational speed: 40 rpm

When the surface roughness on the end surface of the slug which is subjected to the shot peening is measured by using a surface roughness measuring machine (SURFCOM, manufactured by Tokyo Seimitsu Co., Ltd.), the mean width with respect to roughness Sm is 220 μm, and the maximum height Ry is 38 μm.

When powder lubricant zinc stearate is imparted to the end surface of the slug which is subjected to the shot peening by using a brush, the coating amount is 1.0 mg/cm$^2$, and high uniformity is obtained in the coating. The end surface of the slug with which the solid lubricant is coated is set as a bottom surface and is subjected to the impact pressing so as to mold a cylindrical tube having a diameter of 34 mm and a length of 150 mm.

A distribution of the concave portions on the outer circumferential surface of the obtained cylindrical tube E2 is created by using an automatic surface inspecting machine, and when the number of the concave portion and the size thereof are measured based on the distribution of the concave portions by using a laser microscope, the number of the concave portions is decreased approximately 70% as compared with the cylindrical tube prepared in Comparative example 1, and the size of the maximum concave portion is approximately 120 μm.

Example 3

An aluminum columnar slug having a diameter of 34 mm, and a thickness of 15 mm is prepared by punching an aluminum plate having a thickness of 15 mm, and the end surface of the slug is subjected to a shot peening by using a shot-peening apparatus (manufactured by Fuji Seisakusho Co., Ltd.) under the following conditions.

Projection material: ZIRCON 400 manufactured by Fuji Seisakusho Co., Ltd. (center particle diameter size 60 μm)

Projection pressure: 0.4 MPa

Projection time: 10 seconds

Shot distance: 150 mm

Slug rotational speed: 40 rpm

When the surface roughness on the end surface of the slug which is subjected to the shot peening is measured by using a surface roughness measuring machine (SURFCOM, manufactured by Tokyo Seimitsu Co., Ltd.), the mean width with respect to roughness Sm is 190 μm, and the maximum height Ry is 36 μm.

When powder lubricant zinc stearate is imparted to the end surface of the slug which is subjected to the shot peening by using a brush, the coating amount is 1.6 mg/cm$^2$, and high uniformity is obtained in the coating. The end surface of the slug with which the solid lubricant is coated is set as a bottom surface and is subjected to the impact pressing so as to mold a cylindrical tube having a diameter of 34 mm and a length of 150 mm.

A distribution of the concave portions on the outer circumferential surface of the obtained cylindrical tube E3 is created by using an automatic surface inspecting machine, and when the number of the concave portion and the size thereof are measured based on the distribution of the concave portions by using a laser microscope, the number of the concave portions is decreased approximately 25% as compared with the cylindrical tube prepared in Comparative example 1, and the size of the maximum concave portion is approximately 110 μm.

Comparative Example 2

An aluminum columnar slug having a diameter of 34 mm, and a thickness of 15 mm is prepared by punching an aluminum plate having a thickness of 15 mm, and a polishing is performed with waterproof abrasive agent paper.

When the surface roughness on the end surface of the slug which is subjected to the polishing with the waterproof abrasive agent paper is measured by using a surface roughness measuring machine (SURFCOM, manufactured by Tokyo Seimitsu Co., Ltd.), the mean width with respect to roughness Sm is 80 μm, and the maximum height Ry is 19.5 μm.

When powder lubricant zinc stearate is imparted to the surface roughness on the end surface of the slug which is subjected to the polishing with the waterproof abrasive agent paper by using a brush, the coating amount is 0.6 mg/cm$^2$. The end surface of the slug with which the solid lubricant is coated is set as a bottom surface and is subjected to the impact pressing so as to mold a cylindrical tube having a diameter of 34 mm and a length of 150 mm.

A distribution of the concave portions on the outer circumferential surface of the obtained cylindrical tube C2 is created by using an automatic surface inspecting machine, and when the number of the concave portion and the size thereof are measured based on the distribution of the concave portions by using a laser microscope, the number of the concave portions is decreased approximately 50% as compared with the cylindrical tube prepared in Comparative example 1, and the size of the maximum concave portion is approximately 220 μm.

In Examples and Comparative examples, the surface roughness (Sm and Ry) of the slug bottom surface (end surface), a coating amount of lubricants on the bottom surface, and concave portions on the outer circumferential surface of the prepared aluminum tube are indicated in Table 1.

Comparative Example 3

An aluminum columnar slug having a diameter of 34 mm, and a thickness of 15 mm is prepared by punching an aluminum plate having a thickness of 15 mm, and a polishing is performed with waterproof abrasive agent paper.

When the surface roughness on the end surface of the slug which is subjected to the polishing with the waterproof abrasive agent paper is measured by using a surface roughness measuring machine (SURFCOM, manufactured by Tokyo Seimitsu Co., Ltd.), the mean width with respect to roughness Sm is 300 μm, and the maximum height Ry is 50 μm.

When powder lubricant zinc stearate is imparted to the end surface of the slug which is subjected to the polishing with the waterproof abrasive agent paper by using a brush, the coating amount is 2.5 mg/cm$^2$. The end surface of the slug with which the solid lubricant is coated is set as a bottom surface and is subjected to the impact pressing so as to mold a cylindrical tube having a diameter of 34 mm and a length of 150 mm.

A distribution of the concave portions on the outer circumferential surface of the obtained cylindrical tube C3 is created by using an automatic surface inspecting machine, and when the number of the concave portion and the size thereof are measured based on the distribution of the concave portions by using a laser microscope, the number of the concave portions is decreased approximately 50% as compared with the cylindrical tube prepared in Comparative example 1, and the size of the maximum concave portion is approximately 400 μm.

In Examples and Comparative examples, the surface roughness (Sm and Ry) of the slug bottom surface (end surface), a coating amount of lubricants on the slug bottom surface, and concave portions on the outer circumferential surface of the prepared aluminum tube are indicated in Table 1.

TABLE 1

| | Surface roughness of slug bottom surface | | Coating amount of lubricant | Concave portion on outer circumferential surface of aluminum cylindrical tube | |
|---|---|---|---|---|---|
| | Sm | Ry | (mg/cm$^2$) | Number of concave portions (relative numbers) | Maximum diameter of concave portion (μm) |
| Comparative example 1 | 50 μm | 18 μm | 0.3 | 100% | 300 |
| Example 1 | 140 μm | 23 μm | 0.8 | 10% | 100 |
| Example 2 | 220 μm | 38 μm | 1.0 | 30% | 120 |
| Example 3 | 190 μm | 36 μm | 1.6 | 75% | 110 |
| Comparative example 2 | 80 μm | 19.5 μm | 0.6 | 50% | 220 |
| Comparative example 3 | 300 μm | 50 μm | 2.5 | 150% | 400 |

Preparation of Electrophotographic Photoreceptor

Preparation of Electrophotographic Photoreceptor Substrate

The cylindrical metal members which are prepared in respective Examples 1 and 2, and Comparative examples 1 and 2 are subjected to the ironing twice so as to prepare aluminum cylindrical tubes each of which has a diameter of 30 mm, a length of 251 mm, and a thickness of 0.5 mm. The cylindrical tubes are respectively used as conductive substrates (electrophotographic photoreceptor substrates) E1, E2, E3, C1, C2, and C3.

Forming Undercoat Layer 100 parts by weight of zinc oxide: (average particle diameter of 70 nm, manufactured by Tayca Co., Ltd., specific surface area value of 15 $m^2/g$) are mixed and stirred with 500 parts by weight of tetrahydrofuran, 1.3 parts by weight of silane coupling agent (KBM 503, manufactured by Shin-Etsu Chemical Co., Ltd.) are added thereto, and the mixture is stirred for 2 hours. After that, tetrahydrofuran is distilled under vacuum distillation, and sintering is performed at 120° C. for 3 hours, thereby obtaining zinc oxide which is surface-treated with the silane coupling agent.

110 parts by weight of the surface-treated zinc oxide are mixed and stirred with 500 parts by weight of tetrahydrofuran, a solution in which 0.6 parts by weight of alizarin is dissolved into 50 parts by weight of tetrahydrofuran, and the mixture is stirred at 50° C. for 5 hours. After that, zinc oxide to which alizarin is imparted through filtration under reduced pressure is filtered, and is further dried at 60° C. under the reduced pressure, thereby obtaining alizarin-imparted zinc oxide.

60 parts by weight of the alizarin-imparted zinc oxide, 13.5 parts by weight of curing agent (blocked isocyanate, SUMIDUR 3175, manufactured by Sumitomo Bayer Urethane Co., Ltd.), and 15 parts by weight butyral resin (S-LEC BM-1, manufactured by SEKISUI CHEMICAL CO., LTD.) are mixed with 85 parts by weight of methyl ethyl ketone, thereby obtaining a mixture. 38 parts by weight of the mixture are mixed with 25 parts by weight of methyl ethyl ketone, and the resultant mixture is dispersed for 2 hours with 1 mmϕ of glass beads by using a sand mill, thereby obtaining a dispersion.

0.005 parts by weight of dioctyl tin dilaurate and 45 parts by weight of silicone resin particles (TOSPEARL 145, manufactured by Momentive Performance Materials Inc.) are added as catalysts to the obtained dispersion so as to obtain an undercoat layer forming coating liquid.

Each of cylindrical tube E1, E2, E3, C1, C2, and C3 which are prepared in the above Examples 1 and 2, and Comparative example 1 is set as a conductive substrate (electrophotographic photoreceptor substrate), and then the outer circumferential surface thereof is coated with the undercoat layer forming coating liquid by using a dipping coating method, and drying and curing are performed at 170° C. for 30 minutes, thereby obtaining an undercoat layer having a thickness of 23 μm.

Forming Charge Generation Layer

Next, 1 part by weight of hydroxy gallium phthalocyanine having Bragg angle (2θ±0.20) in an X-ray diffraction spectrum with strong diffraction peaks such as 7.5°, 9.9°, 12.5°, 16.3°, 18.6°, 25.1°, and 28.30 is mixed into 1 part by weight of polyvinyl butyral (S-LEC BM-S, manufactured by SEKISUI CHEMICAL CO., LTD.) and 80 parts by weight of acetic acid n-butyl, and the mixture is dispersed with glass beads for one hour by using a paint shaker, thereby preparing a charge generation layer forming coating liquid. The conductive substrate on which the undercoat layer is formed is dipped and coated with the obtained coating liquid, and then heated and dried at 100° C. for 10 minutes, thereby forming a charge generation layer having a thickness of 0.15 μm.

Forming Charge Transport Layer

Subsequently, 2.6 parts by weight of benzidine compound expressed by the following Formula (CT-1) and 3 parts by weight of polymer compound (viscosity-average molecular weight of 40,000) having a repeating unit expressed by the following Formula (B-1) are dissolved in 25 parts by weight of tetrahydrofuran so as to prepare a charge transport layer forming coating liquid. The charge generation layer is coated with the obtained coating liquid by using a dipping coating method, and then heated at 130° C. for 45 minutes, thereby forming a charge transport layer having a thickness of 20 μm. With this, each of the electrophotographic photoreceptors E1, E2, E3, C1, C2, and C3 is prepared.

(CT-1)

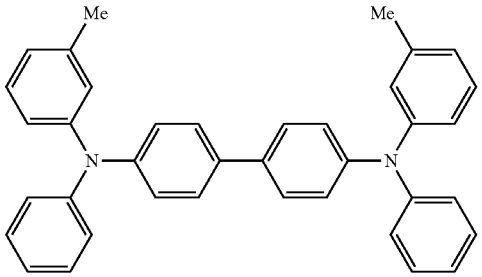

(B-1)

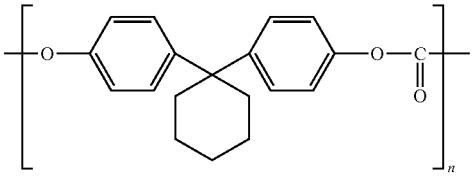

Evaluation and Results

Each of the electrophotographic photoreceptors E1, E2, C1, and C2 is mounted on a process cartridge (DocuPrint P450, manufactured by Fuji Xerox Co., Ltd.), then 20 sheets of image printing are performed on A4-sized sheet (C2-sheet, manufactured by Fuji Xerox Co., Ltd.) with 50% density of half-tone under the environment of 25° C. and 60% RH, and evaluation as to whether or not white points having a diameter which is equal to or larger than 0.5 mm exist on the obtained images is performed.

As a result, in a case of using the photoreceptor E1, E2, or E3 in Example 1 or 2, the white points are not found.

On the other hand, in a case of using the photoreceptor C1, C2, or C3 in Comparative example 1 or 2, five white points having the diameter which is equal to or larger than 0.5 mm are found.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method of preparing a cylindrical metal member, the method comprising:

preparing a metallic ingot having at least one surface having a mean width with respect to roughness Sm in a range of from 100 μm to 220 μm;

imparting a lubricant to the at least one surface of the metallic ingot; and subjecting the metallic ingot to impact pressing while the at least one surface coated with the lubricant is set as a bottom surface, to thereby mold a cylindrical metal member, wherein a maximum height Ry of the at least one surface of the metallic ingot is from 10 μm to 30 μm.

2. The method of preparing a cylindrical metal member according to claim 1, wherein the lubricant is a solid lubricant.

3. The method of preparing a cylindrical metal member according to claim 1, wherein the metallic ingot contains aluminum.

4. The method of preparing a cylindrical metal member according to claim 1, wherein the metallic ingot contains aluminum in an amount of 90.0% by weight or more.

5. The method of preparing a cylindrical metal member according to claim 1, wherein the metallic ingot contains aluminum in an amount of 93.0% by weight or more.

6. The method of preparing a cylindrical metal member according to claim 1, wherein the metallic ingot contains aluminum in an amount of 95.0% by weight or more.

7. The method of preparing a cylindrical metal member according to claim 1, wherein the method further comprises:

subjecting at least one surface of the metallic ingot to shot peening to thereby prepare the metallic ingot having at least one surface having a mean width Sm with respect to roughness in a range of from 100 μm to 220 μm.

8. The method of preparing a cylindrical metal member according to claim 1, wherein, in imparting a lubricant to the at least one surface of the metallic ingot, an amount of the lubricant is from 0.5 $mg/cm^2$ to 1.5 $mg/cm^2$.

9. The method of preparing a cylindrical metal member according to claim 1, wherein, in imparting a lubricant to the at least one surface of the metallic ingot, an amount of the lubricant is from 0.5 $mg/cm^2$ to 1.0 $mg/cm^2$.

10. The method of preparing a cylindrical metal member according to claim 1, wherein, in imparting a lubricant to the at least one surface of the metallic ingot, an amount of the lubricant is from 0.6 $mg/cm^2$ to 0.9 $mg/cm^2$.

11. The method of preparing a cylindrical metal member according to claim 1, wherein the method further comprises:

ironing the cylindrical member after the impact pressing.

12. The method of preparing a cylindrical metal member according to claim 1, wherein the cylindrical metal member is an electrophotographic photoreceptor substrate.

13. A method of preparing a cylindrical metal member, the method comprising:

preparing a metallic ingot having at least one surface having a mean width with respect to roughness Sm in a range of from 100 μm to 220 μm;

imparting a lubricant to the at least one surface of the metallic ingot; and subjecting the metallic ingot to impact pressing while the at least one surface coated with the lubricant is set as a bottom surface, to thereby mold a cylindrical metal member, wherein a maximum height Ry of the at least one surface of the metallic ingot is from 10 μm to 20 μm.

14. A method of preparing an electrophotographic photoreceptor, the method comprising:

preparing a cylindrical metal member prepared according to the method of preparing a cylindrical metal member according to claim 11, as an electrophotographic photoreceptor substrate; and forming a photosensitive layer on an outer circumferential surface of the cylindrical metal member.

* * * * *